US010215030B2

(12) United States Patent
Xu

(10) Patent No.: US 10,215,030 B2
(45) **Date of Patent: *Feb. 26, 2019**

(54) COOLING HOLE FOR A GAS TURBINE ENGINE COMPONENT

(71) Applicant: UNITED TECHNOLOGIES CORPORATION, Hartford, CT (US)

(72) Inventor: JinQuan Xu, Groton, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 32 days.

This patent is subject to a terminal disclaimer.

(21) Appl. No.: 14/766,475

(22) PCT Filed: Feb. 7, 2014

(86) PCT No.: PCT/US2014/015198

§ 371 (c)(1),
(2) Date: Aug. 7, 2015

(87) PCT Pub. No.: WO2014/186006

PCT Pub. Date: Nov. 20, 2014

(65) Prior Publication Data

US 2015/0377033 A1 Dec. 31, 2015

Related U.S. Application Data

(60) Provisional application No. 61/765,212, filed on Feb. 15, 2013.

(51) Int. Cl.
*F01D 5/18* (2006.01)
*F01D 9/06* (2006.01)
(Continued)

(52) U.S. Cl.
CPC ..... *F01D 5/186* (2013.01); *F01D 5/288* (2013.01); *F01D 9/023* (2013.01); *F01D 9/065* (2013.01);
(Continued)

(58) Field of Classification Search
CPC ..... F01D 5/186; F01D 5/288; F01D 9/023; F01D 9/065; F23R 2900/03042; F23R 3/002; F05D 2260/202; F05D 2240/81
See application file for complete search history.

(56) References Cited

U.S. PATENT DOCUMENTS 4,664,597 A * 5/1987 Auxier ..... B23H 9/10 415/115
4,684,323 A * 8/1987 Field ..... F01D 5/186 415/115
(Continued)

FOREIGN PATENT DOCUMENTS

EP 1698757 A2 * 9/2006 ..... F01D 5/18
EP 1698757 A3 9/2006

OTHER PUBLICATIONS

International Preliminary Report on Patentability for International application No. PCT/US2014/015198 dated Aug. 27, 2015.
(Continued)

*Primary Examiner* — Carlos A Rivera
(74) *Attorney, Agent, or Firm* — Carlson, Gaskey & Olds

(57) ABSTRACT

A component for a gas turbine engine according to an exemplary aspect of the present disclosure includes, among other things, a wall having an internal surface, an outer skin and a cooling hole having an inlet extending from the internal surface and merging into a metering section, and a diffusion section downstream of the metering section that extends to an outlet located at the outer skin. At least two lobes are embedded within the diffusion section of the
(Continued)

cooling hole. At least one surface of each of the at least two lobes is at least partially cylindrical.

22 Claims, 6 Drawing Sheets

(51) Int. Cl.

| | |
|---|---|
| ***F23R 3/00*** | (2006.01) |
| ***F01D 9/02*** | (2006.01) |
| ***F01D 11/08*** | (2006.01) |
| ***F23R 3/02*** | (2006.01) |
| ***F01D 5/28*** | (2006.01) |

(52) U.S. Cl.
CPC ..... *F01D 11/08* (2013.01); *F23R 3/002* (2013.01); *F23R 3/02* (2013.01); *F05D 2240/81* (2013.01); *F05D 2260/202* (2013.01); *F23R 2900/03042* (2013.01)

(56) References Cited

U.S. PATENT DOCUMENTS

| | | | | |
|---|---|---|---|---|
| 5,688,104 | A | 11/1997 | Beabout | |
| 7,246,992 | B2 * | 7/2007 | Lee | B23H 9/10 415/115 |
| 7,712,316 | B2 | 5/2010 | Spangler | |
| 7,997,868 | B1 | 8/2011 | Liang | |
| 8,043,058 | B1 | 10/2011 | Liang | |
| 8,057,181 | B1 | 11/2011 | Liang | |
| 8,245,519 | B1 | 8/2012 | Liang | |
| 8,328,517 | B2 | 12/2012 | Liang | |
| 8,683,813 | B2 * | 4/2014 | Xu | F01D 5/186 415/115 |
| 8,689,568 | B2 * | 4/2014 | Kohli | F01D 5/186 415/116 |
| 8,733,111 | B2 * | 5/2014 | Gleiner | F23R 3/06 415/115 |
| 8,763,402 | B2 * | 7/2014 | Xu | F01D 5/186 60/752 |
| 9,273,560 | B2 * | 3/2016 | Gleiner | F01D 5/187 |
| 9,410,435 | B2 * | 8/2016 | Xu | F01D 5/186 |
| 9,422,815 | B2 * | 8/2016 | Xu | F01D 5/186 |
| 9,598,979 | B2 * | 3/2017 | Reed | F01D 25/12 |
| 2008/0003096 | A1 | 1/2008 | Kohli et al. | |
| 2009/0067998 | A1 * | 3/2009 | Beck | F01D 5/186 415/175 |
| 2010/0068032 | A1 * | 3/2010 | Liang | F01D 5/186 415/115 |
| 2011/0097191 | A1 * | 4/2011 | Bunker | F01D 5/186 415/115 |
| 2011/0293423 | A1 | 12/2011 | Bunker et al. | |
| 2011/0311369 | A1 | 12/2011 | Ramachandran et al. | |
| 2012/0167389 | A1 * | 7/2012 | Lacy | F01D 5/186 29/889.1 |
| 2013/0294889 | A1 * | 11/2013 | Malak | F01D 5/186 415/115 |
| 2014/0099189 | A1 * | 4/2014 | Morris | F01D 5/186 415/115 |

OTHER PUBLICATIONS

Extended European Search Report for Application No. EP 14 79 7457 dated Sep. 12, 2016.

The Nekomimi Cooling Technology: Cooling Holes With Ears for High-Efficient Film Cooling, By: Karsten Kusterer, et al., GT2011-45524, Proceedings of ASME Turbo Expo 2011, Jun. 6-10, 2011, Vancover, British Columbia, Canada, pp. 1-11.

International Search Report and Written Opinion of the International Searching Authority for International application No. PCT/US2014/015198 dated Dec. 23, 2014.

* cited by examiner

COOLING HOLE FOR A GAS TURBINE ENGINE COMPONENT

BACKGROUND

This disclosure relates to a gas turbine engine, and more particularly to a gas turbine engine component having a cooling hole with two or more embedded lobes.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

The combustion gases generated by the gas turbine engine are typically extremely hot, and therefore the components that extend into the core flow path of the gas turbine engine may be subjected to extremely high temperatures. Thus, air cooling arrangements may be provided for many of these components.

For example, airfoils of blades and vanes may extend into the core flow path of a gas turbine engine. The airfoils may include cooling holes that are part of a cooling arrangement of the component. Cooling airflow is communicated into an internal cavity of the component and can be discharged through one or more of the cooling holes to provide a boundary layer of film cooling air at the outer skin of the component. The film cooling air provides a bather that protects the underlying substrate of the component from the hot combustion gases that are communicated along the core flow path.

SUMMARY

A component for a gas turbine engine according to an exemplary aspect of the present disclosure includes, among other things, a wall having an internal surface, an outer skin and a cooling hole having an inlet extending from the internal surface and merging into a metering section, and a diffusion section downstream of the metering section that extends to an outlet located at the outer skin. At least two lobes are embedded within the diffusion section of the cooling hole. At least one surface of each of the at least two lobes is at least partially cylindrical.

In a further non-limiting embodiment of the foregoing component, the wall is part of one of an airfoil, a turbine vane, a turbine blade, a blade outer air seal (BOAS), a combustor liner and a platform.

In a further non-limiting embodiment of either of the foregoing components, a trailing edge of the at least two lobes is longitudinally offset from a trailing edge of the diffusion section.

In a further non-limiting embodiment of any of the foregoing components, the diffusion section extends to a trailing edge, and the trailing edge is linear.

In a further non-limiting embodiment of any of the foregoing components, the at least two lobes include a first lobe and a second lobe that diverge longitudinally and laterally from the metering section.

In a further non-limiting embodiment of any of the foregoing components, the diffusion section includes a curved transition portion that extends between the first lobe and the second lobe.

In a further non-limiting embodiment of any of the foregoing components, the curved transition portion extends to the outer skin.

In a further non-limiting embodiment of any of the foregoing components, the curved transition portion is below the outer skin.

In a further non-limiting embodiment of any of the foregoing components, the component comprises a coating layer at the outer skin. The diffusion section extends into the coating layer.

In a further non-limiting embodiment of any of the foregoing components, an entirety of the diffusion section is formed within the coating layer and the metering section is formed entirely within a substrate of the wall.

In a further non-limiting embodiment of any of the foregoing components, a first portion of the diffusion section extends into the coating layer and a second portion of the diffusion section extends within a substrate of the wall.

In a further non-limiting embodiment of any of the foregoing components, the at least two lobes include a first lobe and a second lobe, and the diffusion section includes a curved transition portion that extends between the first lobe and the second lobe at a position that is upstream from a downstream portion of the diffusion section.

In a further non-limiting embodiment of any of the foregoing components, the at least two lobes include a leading edge, a trailing edge, a first side surface that extends between the leading edge and the trailing edge along a first edge, the first edge diverging laterally from the leading edge and converging laterally before reaching the trailing edge.

In a further non-limiting embodiment of any of the foregoing components, the at least two lobes include a second side surface that extends from the trailing edge partially toward the leading edge along a second edge, the second edge diverging proximally.

In a further non-limiting embodiment of any of the foregoing components, the at least two lobes extend at an angle that is between 10° and 60° relative to an axis of the metering section.

In a further non-limiting embodiment of any of the foregoing components, the diffusion section defines an asymmetric design.

In a further non-limiting embodiment of any of the foregoing components, the diffusion section includes a downstream surface that extends at an angle between 135° and 180° relative to an axis of the metering section.

In a further non-limiting embodiment of any of the foregoing components, the at least two lobes include different radii.

A method of forming a cooling hole in a component of a gas turbine engine according to another exemplary aspect of the present disclosure includes, among other things, forming a cooling hole in a wall of the component including an inlet extending from an internal surface of the wall toward an outer skin of the wall, the inlet merging into a metering section. The cooling hole is provided with a diffusion section downstream of the metering section, the diffusion section including at least two lobes that are embedded within the diffusion section of the cooling hole, the at least two lobes having a surface that is at least partially cylindrical.

In a further non-limiting embodiment of the foregoing method, the method includes the step of providing a coating layer at the outer skin of the wall.

In a further non-limiting embodiment of either of the foregoing methods, the method includes the step of providing the cooling hole with the diffusion section includes forming the diffusion section entirely within the coating layer.

In a further non-limiting embodiment of any of the foregoing methods, the method includes the step of providing the cooling hole with the diffusion section includes forming a trailing edge of the at least two lobes at a longitudinally offset position from a trailing edge of the diffusion section.

The various features and advantages of this disclosure will become apparent to those skilled in the art from the following detailed description. The drawings that accompany the detailed description can be briefly described as follows.

DETAILED DESCRIPTION

Figure 1:
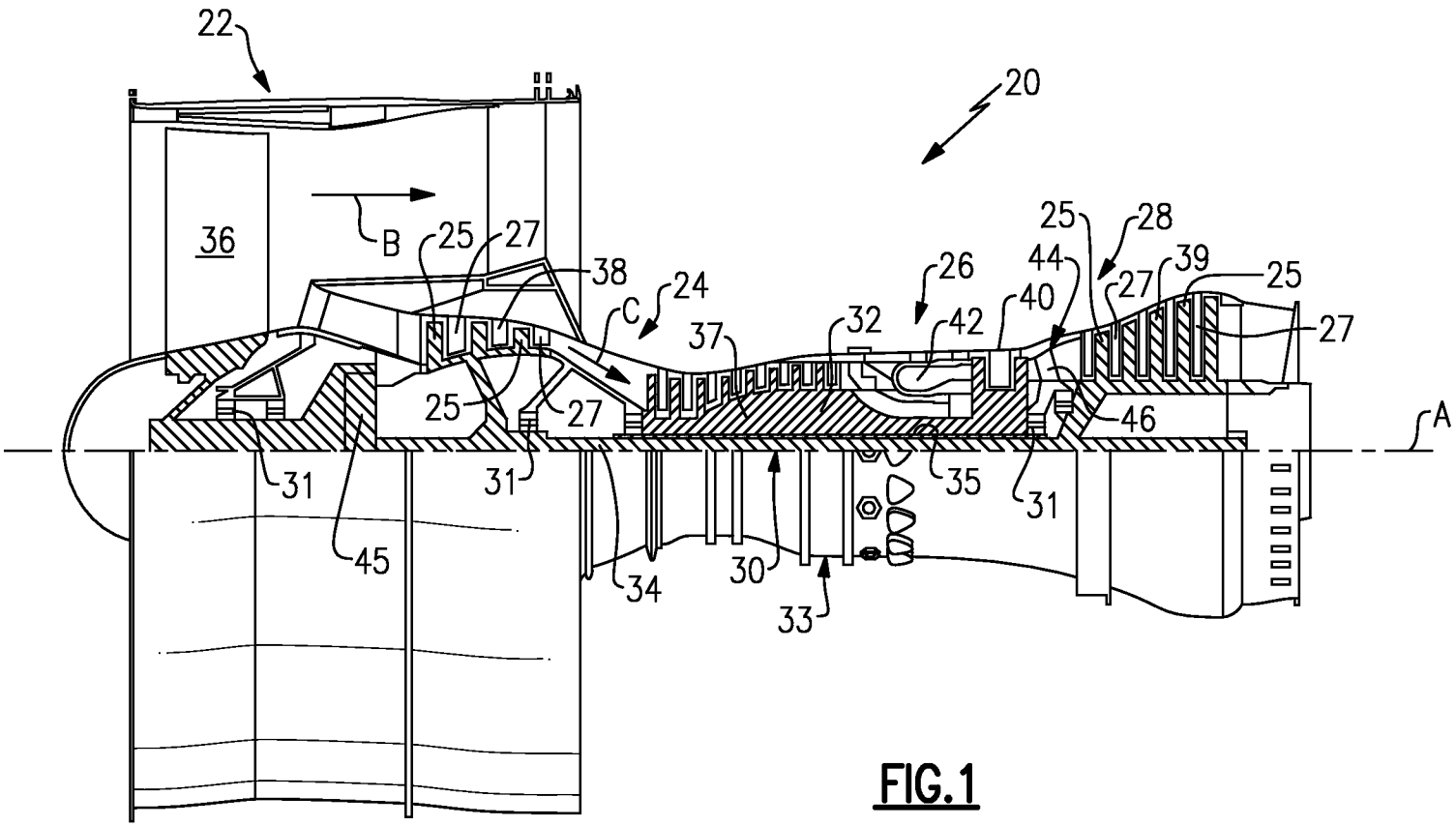
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}°\text{R})/(518.7°\text{R})]^{0.5}$. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require dedicated cooling techniques to cool the parts during engine operation. This disclosure relates to cooling holes that may be incorporated into the components of the gas turbine engine as part of a cooling arrangement for achieving such cooling.

Figure 2A:
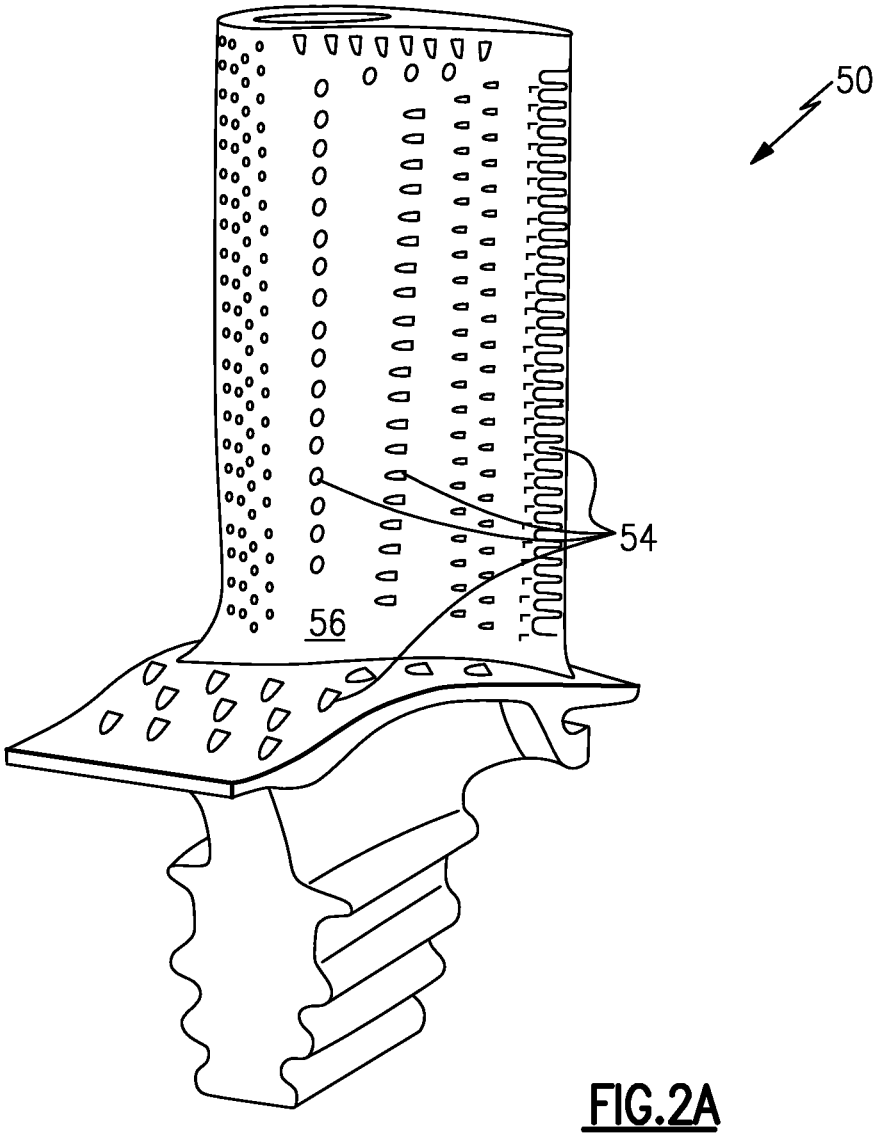
FIG. 2A illustrates a component that may incorporate one or more cooling holes according to this disclosure.
Figure 2B:
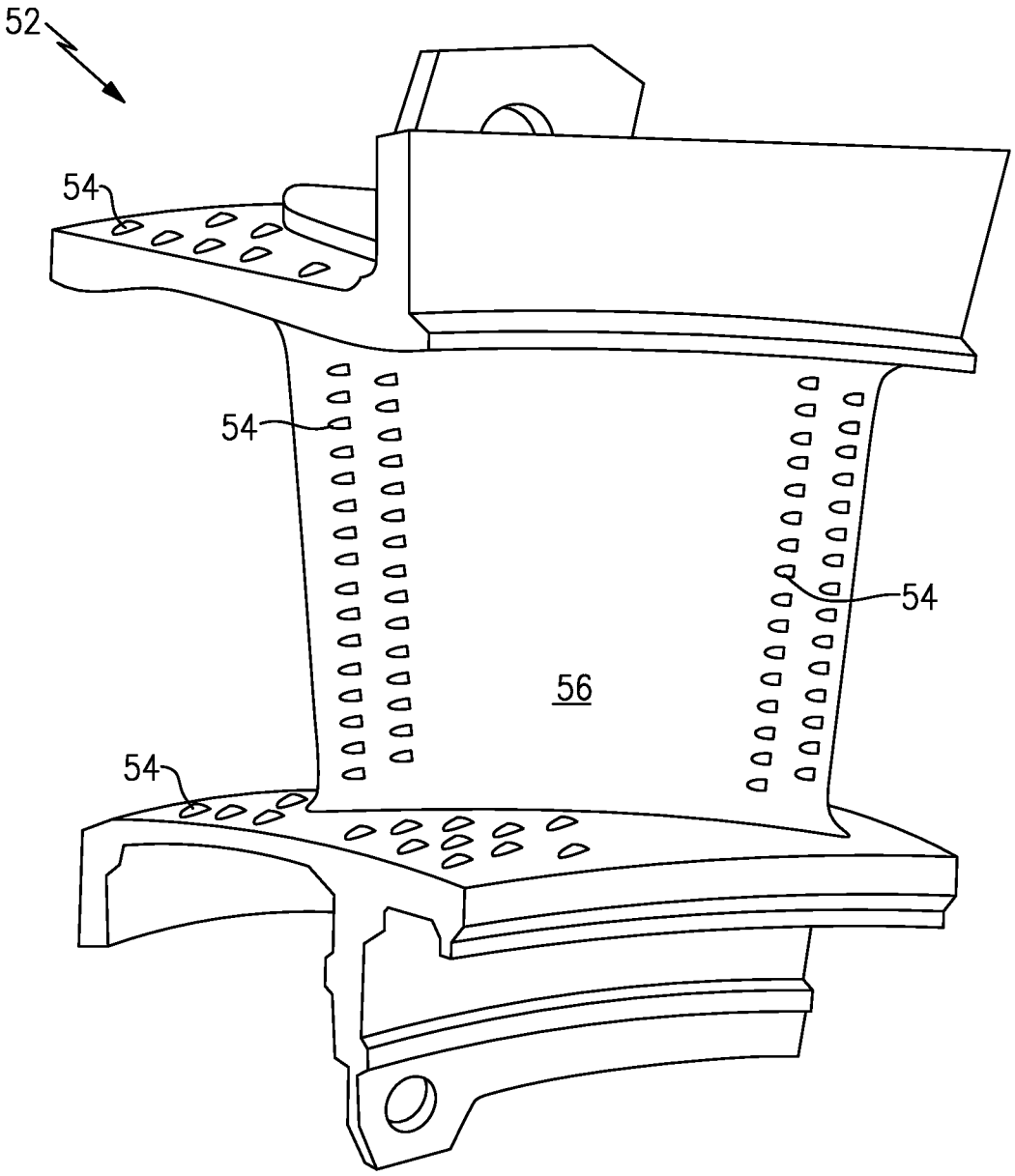
FIG. 2B illustrates a second embodiment.

FIG. 2A illustrates a first embodiment of a component 50 that can be incorporated into a gas turbine engine, such as the gas turbine engine 20 of FIG. 1. The component 50 is illustrated as a turbine blade. FIG. 2B illustrates a second embodiment of a component 52 that can be incorporated into the gas turbine engine 20. In the FIG. 2B embodiment, the component 52 is a turbine vane. Although described and depicted herein as turbine components, the features of this disclosure could be incorporated into any component that requires dedicated cooling, including but not limited to any component that is positioned within the core flow path C (FIG. 1) of the gas turbine engine 20. For example, blade outer air seals (BOAS) and combustor liners may also benefit from these teachings.

As shown in FIGS. 2A and 2B, the components 50, 52 may include one or more cooling holes 54 that are formed at an outer skin 56 of the components 50, 52. Any of these cooling holes 54 may benefit from having at least two embedded lobes. Exemplary characteristics of such embedded lobed cooling holes will be discussed below. The exemplary cooling holes 54 can help minimize vortexes in the cooling air that is communicated through the cooling holes 54. This may allow the cooling air to remain along the outer skin 56 of the components 50, 52 for a greater period of time than has been the case with prior art cooling holes, thereby more effectively and efficiently providing film cooling air at the outer skin 56.

Figure 3:
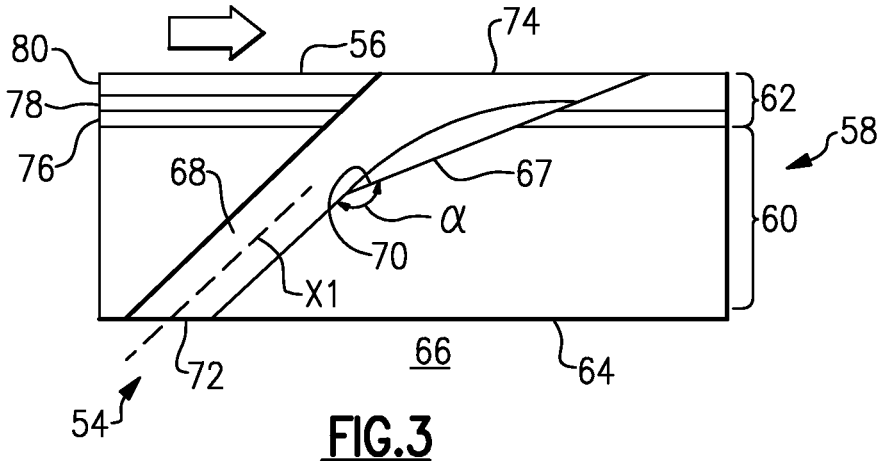
FIG. 3 illustrates an exemplary cooling hole that can be incorporated into a component of a gas turbine engine.

FIG. 3 illustrates one exemplary cooling hole 54 that can be formed within a component, such as the component 50, the component 52 or any other gas turbine engine component. The cooling hole 54 may be disposed within a wall 58. The wall 58 is formed from a substrate 60, and optionally a coating layer 62 that is disposed on top of the substrate 60. In one embodiment, the substrate 60 is a metallic substrate and the coating layer 62 includes either a ceramic or a metallic coating.

The wall 58 extends from an internal surface 64 that can face into a cavity 66 of the component. For example, the cavity 66 may be a cooling cavity that receives a cooling air to cool the wall 58. The cooling air may flow from the cavity 66 into the cooling hole 54. The wall 58 also includes an outer skin 56 on an opposite side from the internal surface 64.

In one embodiment, the cooling hole 54 includes a metering section 68 and a diffusion section 70. An inlet 72 of the cooling hole 54 may extend from the internal surface 64 and merges into the metering section 68. The metering section 68 extends into an enlarged diffusion section 70, which may extend to the outlet 74 at the outer skin 56. The design characteristics of these sections of the cooling hole 54 are exemplary, and this disclosure could extend to any number of sizes and orientations of the several distinct sections of the cooling hole 54.

The coating layer 62 of the wall 58 may include sublayers, such as a bonding layer 76, an inner coating layer 78 and an outer coating layer 80. In one embodiment, the outer coating layer 80 includes a thermal barrier coating that helps the component survive the extremely hot temperatures it may face during gas turbine engine operation. The inner coating layer 78 may also be a thermal barrier coating, or a corrosion resistant coating, or any other suitable coating. Of course, there may be fewer or additional layers, such as a third thermal barrier coating outwardly of the outer coating layer 80. Any number of other combinations of coatings, or having no coating layers at all, would also come within the scope of this disclosure.

Figure 4:
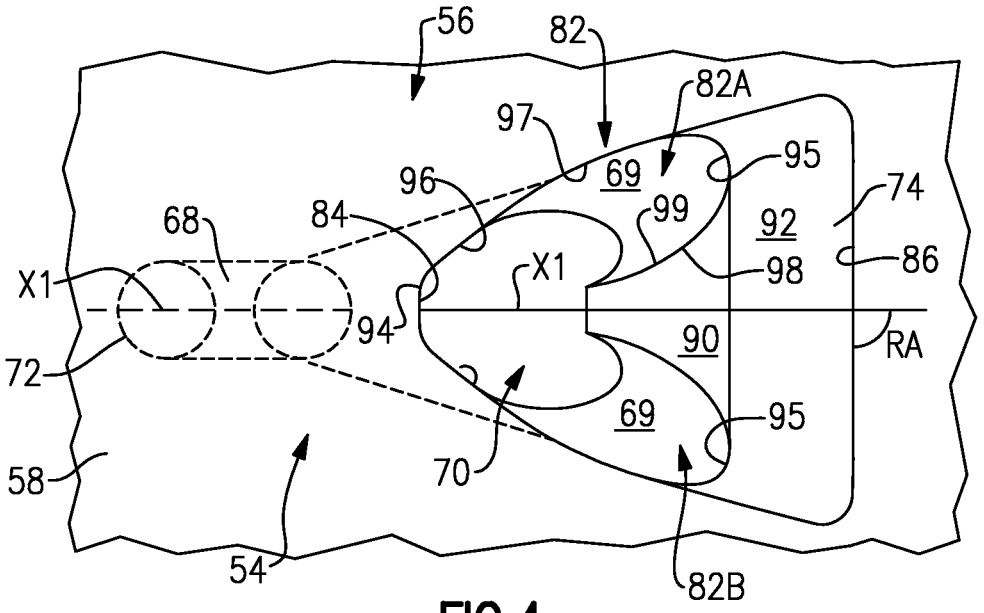
FIG. 4 is another view of an exemplary cooling hole.

FIG. 4 illustrates additional features of an exemplary cooling hole 54. The cooling hole 54 includes the inlet 72, the metering section 68, the diffusion section 70 and the outlet 74. The inlet 72 may be an opening located on a surface of the wall 58, or through the internal surface 64 (not shown in FIG. 4). In one embodiment, cooling air may enter the cooling hole 54 through the inlet 72 and may be communicated through the metering section 68 and the diffusion section 70 before exiting the cooling hole 54 at the outlet 74 to provide a boundary layer of film cooling air along the outer skin 56 of the wall 58.

The metering section 68 is adjacent to and downstream from the inlet 72 and controls (meters) the flow of cooling air through the cooling hole 54. In exemplary embodiments, the metering section 68 has a substantially constant flow area from the inlet 72 to the diffusion section 70. The metering section 68 can have circular, oblong (oval or elliptical), racetrack (oval with two parallel sides having straight portions), or crescent shaped axial cross-sections. The metering section 68 shown in FIGS. 3 and 4 has a circular cross-section. In other exemplary embodiments, the metering section 68 is inclined with respect to the internal surface 64 as best illustrated in FIG. 3 (i.e., the metering section 68 may be non-perpendicular to the internal surface 64).

The diffusion section 70 is adjacent to and downstream from the metering section 68. Cooling air can diffuse within the diffusion section 70 before exiting the cooling hole 54 at the outlet 74 along the outer skin 56. The diffusion section 70 may include a downstream surface 67 that extends at an angle $\alpha$ of between 135° and 180° relative to an axis X1 of the metering section 68.

In one exemplary embodiment, at least two lobes 82 are embedded within the diffusion section 70 of the cooling hole 54. In other words, the lobes 82 may be buried within the diffusion section 70. In this particular embodiment, the diffusion section 70 includes a first lobe 82A and a second lobe 82B that are each embedded within the diffusion section 70. In one exemplary embodiment, at least a portion of a surface 69 of each lobe 82A, 82B is at least partially cylindrical. The surface 69 may be located anywhere along the lobes 82A, 82B. In other embodiments, the lobes 82A, 82B may be cat-ear shaped, or could include other shapes within the scope of this disclosure. In yet another embodiment, the surface 69 of the first lobe 82A includes a different radius than a radius of the surface 69 of the second lobe 82B (i.e., the lobes 82A, 82B are asymmetric).

The first lobe 82A and the second lobe 82B may diverge longitudinally and laterally from the metering section 68. The terms longitudinally and laterally are defined relative to an axis X1 of the metering section 68. The outlet 74 of the diffusion section 70 can include a leading edge 84 and a trailing edge 86. Each lobe 82A, 82B may also include a trailing edge 95 that is longitudinally offset from the trailing edge 86 of the diffusion section 70. In this way, the lobes 82A, 82B are embedded within the diffusion section 70.

In one embodiment, a curved transition portion 90 extends between the first lobe 82A and the second lobe 82B at a position that is upstream from a downstream portion 92 of the diffusion section 70 (i.e., the curved transition portion 90 is below the outer skin 56). The downstream portion 92 is a curved surface, in one embodiment. In another embodiment, the curved transition portion 90 extends to the trailing edge 86 (i.e., the curved transition portion 90 extends to the outer skin 56).

The first lobe 82A may include a leading edge 94 (which can be located at the leading edge 84 of the outlet 74), a trailing edge 95, and a first side surface 96 that extends between the leading edge 94 and the trailing edge 95 along a first edge 97. The first edge 97 may diverge laterally from the leading edge 94 and converge laterally before reaching the trailing edge 95. The first lobe 82A can additionally include a second side surface 98 that extends from the trailing edge 95 partially toward the leading edge 94 along a second edge 99. The second edge 99 diverges proximally, in this embodiment. The second lobe 82B can include a similar configuration as the first lobe 82A.

As can be appreciated from FIG. 4, the trailing edge 86 of the outlet 74 of the diffusion section 70 is generally linear, and defines the extreme most downstream end across the entire width of the cooling hole 54. Stated another way, for a symmetrical embodiment such as shown in FIG. 4, the trailing edge 86 defines an angle RA relative to the centerline axis X1. In one embodiment, the angle RA is a square or right angle. Of course, cooling holes with non-square trailing edges could also benefit from these teachings.

The diffusion section 70 can include multiple lobes 82 and these lobes can look quite different from the FIG. 4 embodiment so long as the basic description of an embedded lobe as detailed above is achieved. For example, the cooling holes may encompass different combinations of the various features that are shown, including metering sections with a variety of shapes, and diffusion sections with one, two, three or even more lobes, or a combination with different downstream portions 92 bordered by various trailing edges 86. The lobes 82 could also be asymmetrical within the scope of this disclosure.

Figure 5:
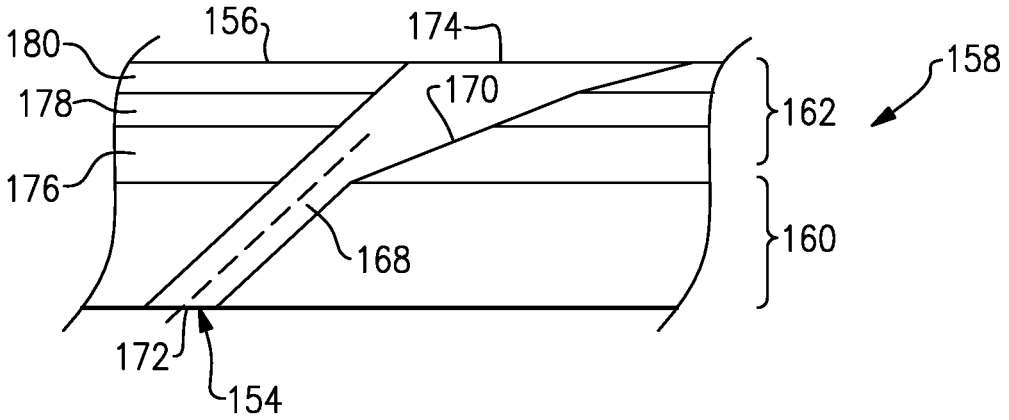
FIG. 5 shows another embodiment.

Another embodiment of a cooling hole 154 is illustrated in FIG. 5. In this embodiment, the inlet 172 of the cooling hole 154 extends into a metering section 168, and then to the diffusion section 170. The diffusion section 170 extends to the outlet 174 at the outer skin 156 of the wall 158. The coating layer 162 may incorporate layers 176, 178, and 180. The entire diffusion section 170 is formed within the coating layer 162 and the metering section 168 is formed entirely within the substrate 160, in this embodiment.

Figure 6:
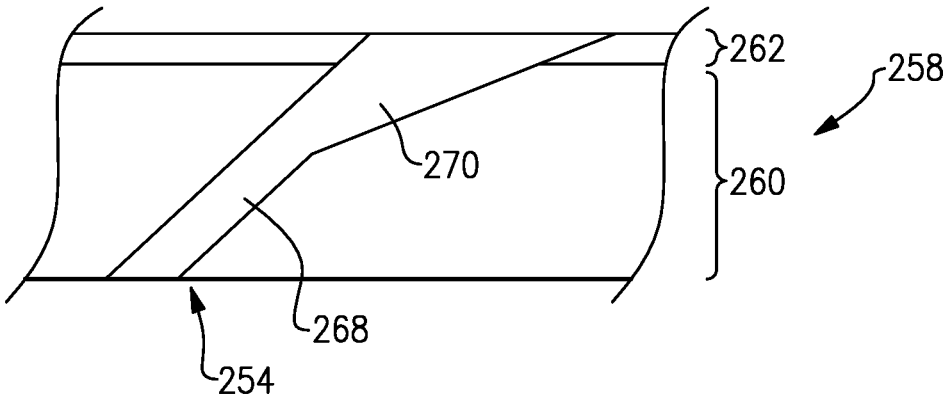
FIG. 6 shows yet another embodiment.

Another embodiment of a cooling hole 254 is shown by FIG. 6. In this embodiment, only a portion of the diffusion section 270 extends into the coating layer 262. The remaining portion of the diffusion section 270, as well as the entirety of the metering section 268, may extend within the substrate 260 of the wall 258, in this embodiment.

It should be understood that although the disclosed embodiments show the outer skin at an outer surface of a component, it is possible that the wall could be an interior wall, and thus the outer skin would not necessarily be at an outer surface of the component.

Figure 7:
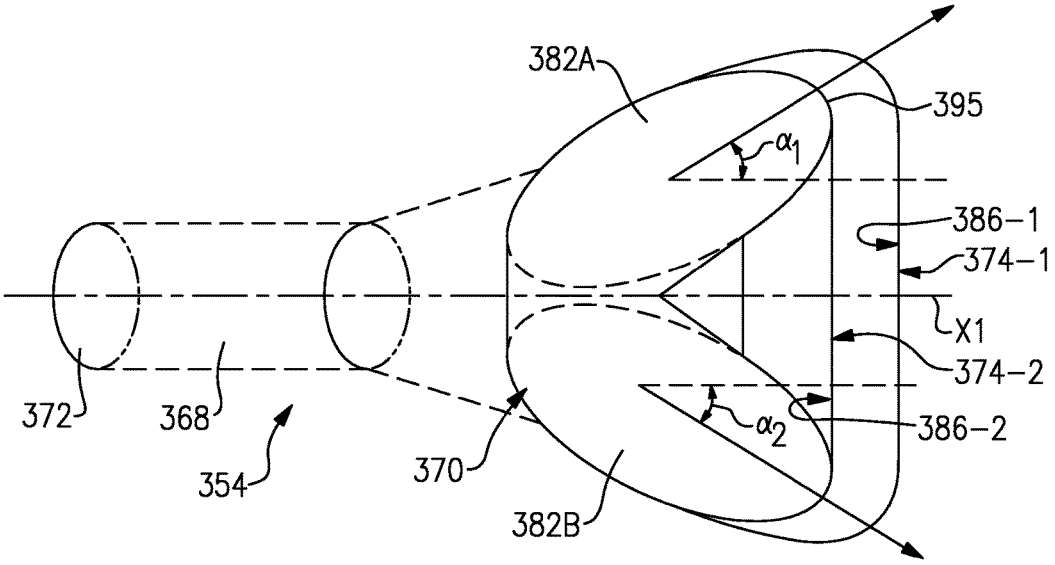
FIG. 7 shows another exemplary cooling hole.
Figure 8:
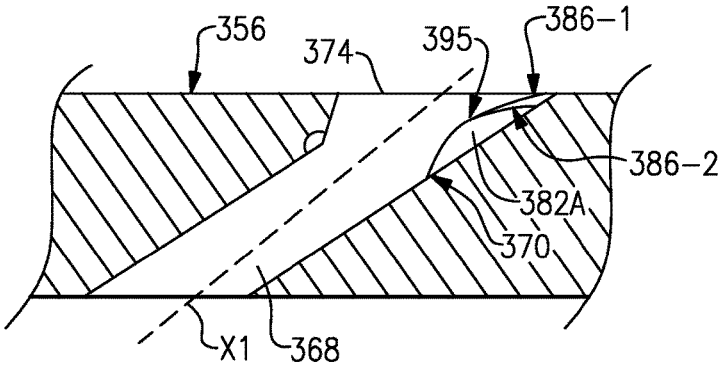
FIG. 8 illustrates another view of the cooling hole of FIG. 7.

FIGS. 7 and 8 illustrate additional embodiments of a cooling hole 354. In this embodiment, the cooling hole 354 includes an inlet 372, a metering section 368, a diffusion section 370 and an outlet 374 (shown as two possible outlets 374-1 and 374-2). The diffusion section 370 may include a first lobe 382A and a second lobe 382B that are each embedded within the diffusion section 370. For example, in one embodiment, the first lobe 382A and the second lobe 382B may include trailing edges 395 that are longitudinally offset from a trailing edge 386-1 of the diffusion section 370. In this way, the trailing edges 395 are below the outer skin 356 (see FIG. 8). Alternatively, the trailing edges 395 may extend to a trailing edge 386-2 of the diffusion section 370 such that the lobes 382A and 382B extend to the outer skin 356.

The first lobe 382A and the second lobe 382B may diverge longitudinally and laterally relative to an axis X1 of the metering section 368. In one embodiment, the first lobe 382A extends at a first angle $\alpha 1$ relative to the axis X1 and the second lobe 382B may extend a second angle $\alpha 2$ relative to the axis X1. The first and second angles $\alpha 1$ and $\alpha 2$ may be equal or different angles to provide either a symmetric or asymmetric diffusion section 370. In one embodiment, the first and second angles $\alpha 1$ and $\alpha 2$ are between 10° and 60° relative to the axis X1.

In another embodiment, a cross-section through any axial location of the diffusion section 370 is circular. In this way, the cooling hole 354 can be laser jet formed or water jet formed, for example.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A component for a gas turbine engine, comprising:

a wall having an internal surface and an outer skin;

a cooling hole having an inlet extending from said internal surface and merging into a metering section, and a diffusion section downstream of said metering section that extends to an outlet located at said outer skin;

at least two lobes embedded within said diffusion section of said cooling hole such that a trailing edge of said at least two lobes is upstream from a trailing edge of said diffusion section, wherein at least one surface of each of said at least two lobes is at least partially cylindrical;

wherein said at least two lobes each include a leading edge, said trailing edge, a first side surface that extends between said leading edge and said trailing edge of said at least two lobes along a first curved edge, and a second side surface that extends between said trailing edge of said at least two lobes and said leading edge along a second curved edge; and a curved transition portion extending between said second curved edge of a first lobe of said at least two lobes and said first curved edge of a second lobe of said at least two lobes, wherein each of said first curved edges is curved along an entire length of said first side surfaces and each of said second curved edges is curved along an entire length of said second side surfaces.

2. The component as recited in claim 1, wherein said wall is part of one of an airfoil, a turbine vane, a turbine blade, a blade outer air seal (BOAS), a combustor liner and a platform.

3. The component as recited in claim 1, wherein said trailing edge of said diffusion section is linear.

4. The component as recited in claim 1, wherein said first lobe and said second lobe diverge longitudinally and laterally from said metering section.

5. The component as recited in claim 1, wherein said curved transition portion extends to said outer skin.

6. The component as recited in claim 1, wherein said curved transition portion is below said outer skin.

7. The component as recited in claim 1, comprising a coating layer at said outer skin, wherein said diffusion section extends into said coating layer.

8. The component as recited in claim 7, wherein an entirety of said diffusion section is formed within said coating layer and said metering section is formed entirely within a substrate of said wall.

9. The component as recited in claim 7, wherein a first portion of said diffusion section extends into said coating layer and a second portion of said diffusion section extends within a substrate of said wall.

10. The component as recited in claim 1, wherein said curved transition portion extends between said first lobe and said second lobe at a position that is upstream from a downstream portion of said diffusion section.

11. The component as recited in claim 1, wherein said first curved edge diverges laterally from said leading edge and converges laterally before reaching said trailing edge.

12. The component as recited in claim 11, wherein said second curved edge diverges proximally.

13. The component as recited in claim 1, wherein said at least two lobes extend at an angle that is between 10° and 60° relative to an axis of said metering section.

14. The component as recited in claim 1, wherein said diffusion section defines an asymmetric design.

15. The component as recited in claim 1, wherein said diffusion section includes a downstream surface that extends at an angle between 135° and 180° relative to an axis of said metering section.

16. The component as recited in claim 1, wherein said at least two lobes include different radii.

17. A method of forming a cooling hole in a component of a gas turbine engine, comprising the step of:

forming a cooling hole in a wall of the component including an inlet extending from an internal surface of the wall toward an outer skin of the wall, the inlet merging into a metering section; and providing the cooling hole with a diffusion section downstream of the metering section, the diffusion section including at least two lobes that are embedded within the diffusion section of the cooling hole, the at least two lobes having a surface that is at least partially cylindrical, wherein the step of providing the cooling hole with the diffusion section includes forming a trailing edge of the at least two lobes at an upstream position from a trailing edge of the diffusion section;

wherein the at least two lobes each include a leading edge, the trailing edge, a first side surface that extends between the leading edge and the trailing edge of the at least two lobes along a first curved edge, and a second side surface that extends between the trailing edge of the at least two lobes and the leading edge along a second curved edge, wherein each of the first curved edges is curved along an entire length of the first side surfaces and each of the second curved edges is curved along an entire length of the second side surfaces.

18. The method as recited in claim 17, comprising the step of providing a coating layer at the outer skin of the wall.

19. The method as recited in claim 18, wherein the step of providing the cooling hole with the diffusion section includes forming the diffusion section entirely within the coating layer.

20. The component as recited in claim 1, wherein said trailing edge of said at least two lobes is longitudinally offset in a direction toward said internal surface from said trailing edge of said diffusion section.

21. The method as recited in claim 17, wherein the trailing edge of the at least two lobes is longitudinally offset in a direction toward the internal surface from the trailing edge of the diffusion section.

22. A component for a gas turbine engine, comprising:

a wall having an internal surface and an outer skin;

a cooling hole having an inlet extending from said internal surface and merging into a metering section, and a diffusion section downstream from said metering section that extends to an outlet located at said outer skin;

a first lobe and a second lobe embedded within said diffusion section of said cooling hole such that a first trailing edge of each of said first lobe and said second lobe is upstream from a second trailing edge of said diffusion section;

wherein said first lobe and said second lobe each include a leading edge, said first trailing edge, a first side surface that extends between said leading edge and said first trailing edge along a first curved edge, and a second side surface that extends between said first trailing edge and said leading edge along a second curved edge; and a third lobe embedded within said first lobe.

* * * * *